US007065903B2

(12) United States Patent
Jones et al.

(10) Patent No.: US 7,065,903 B2
(45) Date of Patent: Jun. 27, 2006

(54) FABRIC TREATMENT DEVICE

(75) Inventors: David Jones, Merseyside (GB); Philip Andrew Tarrant, Edgewater, NJ (US)

(73) Assignee: Unilever Home & Personal Care USA, Division of Conopco, Inc., Greenwich, CT (US)

( * ) Notice: Subject to any disclaimer, the term of this patent is extended or adjusted under 35 U.S.C. 154(b) by 21 days.

(21) Appl. No.: 10/430,119

(22) Filed: May 6, 2003

(65) Prior Publication Data

US 2004/0221476 A1 Nov. 11, 2004

(51) Int. Cl.
*F26B 11/02* (2006.01)

(52) U.S. Cl. ..... 34/597

(58) Field of Classification Search ..... 34/409, 34/601, 112, 600, 192, 202, 235, 604, 605, 34/106, 72, 60, 597, 329, 499; 206/460, 524.1
See application file for complete search history.

(56) References Cited

U.S. PATENT DOCUMENTS

| | | | | | |
|---|---|---|---|---|---|
| 2,851,791 | A | * | 9/1958 | Olthuis | 34/90 |
| 3,435,537 | A | * | 4/1969 | Rumsey, Jr. | 34/72 |
| 3,701,202 | A | * | 10/1972 | Compa et al. | 34/72 |
| 3,736,668 | A | * | 6/1973 | Dillarstone | 34/60 |
| 4,014,432 | A | | 3/1977 | Clothier et al. | |
| 5,072,526 | A | | 12/1991 | Hirota et al. | |
| 6,609,311 | B1 | * | 8/2003 | Hagemann et al. | 34/597 |

FOREIGN PATENT DOCUMENTS

| | | |
|---|---|---|
| EP | 361 593 | 4/1990 |
| GB | 1 399 728 | 8/1972 |
| WO | 02/33161 | 4/2002 |
| WO | 02/33161 A1 | 4/2002 |
| WO | 2004/031470 | 4/2004 |
| WO | 2004031470 A1 | 4/2004 |

OTHER PUBLICATIONS

PCT International Search Report in a PCT application PCT/EP 2004/004259.

* cited by examiner

*Primary Examiner*—Kenneth Rinehart
(74) *Attorney, Agent, or Firm*—Milton L. Honig

(57) ABSTRACT

A device for treating fabrics in a tumble dryer during multiple tumble drying cycles, the device comprising a support member attachable to a reservoir for storing fabric treatment composition, the support member including attachment means for attachment of the device to the tumble dryer interior, preferably the door, wherein the device, preferably the support member, includes one or more flexible portions which contact the dryer interior and allow positional adjustment of the device relative to the tumble dryer interior, during attachment by the user.

19 Claims, 3 Drawing Sheets

FABRIC TREATMENT DEVICE

The present invention relates to a device for treating, fabrics inside a tumble dryer.

In the treatment of fabrics in a tumble dryer it is known to use conditioner dispensing articles, comprising means for attachment of the substrate to the tumble dryer wall. Other proposals, such as for instance disclosed in GB 1,399,728 involve the use of separate means for attaching the conditioning article to the tumble dryer wall.

EP-B-361593 concerns an alternative approach in which a fabric conditioning article comprises a combination of a substrate and a fabric conditioning composition, the substrate being a porous material with a specified void volume and cell count. The article of EP-B-361593 is designed to adhere to the tumble dryer wall.

A problem with some devices of this kind is that it can be difficult to achieve a reliable attachment of the device to the tumble dryer interior, especially a door which can vary in curvature at the surface where the device is to be attached.

It is an object of the present invention to provide an improved device suitable for treatment fabrics in a tumble dryer, and in particular a device with improved attachment properties.

According to the present invention, there is provided a device for treating fabrics in a tumble dryer during multiple tumble drying cycles, the device comprising a support member attachable to a reservoir for storing fabric treatment composition, the support member including attachment means for attachment of the device to the tumble dryer interior, preferably the door, wherein the device, preferably the support member, includes one or more flexible portions which contact the dryer interior and allow positional adjustment of the device relative to the tumble dryer interior, during attachment by the user.

With this arrangement, the user can positionally adjust the device during attachment to the dryer interior, and consequently achieve more effective attachment. The user can also apply force to the device to ensure attachment and the flexible portions do not inhibit this. This is particularly advantage where the device is rigid or includes rigid portions which without some flexibility would restrict positional adjustment/application of sufficient force.

In a preferred embodiment the flexible portion extends around the entire periphery of the device and ensures that when attached, there are no gaps around the periphery. Exclusion of gaps has at least two advantages. The first is that it is less likely that any articles of clothing or parts of articles can become trapped behind the device and pull the device off the door. Secondly, it is less likely that lint can become entrapped behind the device and build up over time.

The device may have a rigid perimeter which is bounded by a flexible edging or skirt.

The flexible portion/s may be attached in any suitable ay, eg. by friction fit, snap fit or adhesive. The flexible portion/s may be (in whole or in part) integral with the device (support member), e.g. by means of a bi-injection moulding process.

A suitable material for the flexible portion/s is a TPE (thermoplastic elastomer).

The device may have a curved e.g. circular/oval perimeter, and may be of any suitable size for manual handling. The device may have diameter of from about 60 to about 140 mm, preferably from about 60 to about 110 mm, and more preferably from about 90 mm to about 110 mm, and even more preferably approximately 10 cm and including all ranges subsumed therein.

A device having a 10cm diameter is very easily handled. With a device of this size, the skirt may have a outer diameter (that is, the diameter which contacts the tumble dryer interior) of from about 70 to about 120 mm and including all ranges subsumed therein.

The flexible portion e.g. skirt may be at least 8mm deep.

The attachment means may be a suction cup arrangement or may be a hook-and-loop or mushroom-head type reclosable fastener such Velcro™.

The attachment means is preferably remote from the flexible portion/s and more preferably at least in part surrounded by the flexible portion/s. In this when force is applied to the device in the area of the attachment means it is not necessarily directly applied to the flexible portion/s, allowing optimal positional adjustment and attachment.

The flexible portion/s may be inclined outwardly and preferably relative to the direction of main component of the force for attachment to allow greater flexing of the perimeter during attachment.

The flexible portion/s may have, in whole or part, a curved profile. For example the flexible portion/s may curve in the direction of the above mentioned inclination.

Some modern tumble dryers have a one or more small holes in the inside of the door to allow moisture out of the tumble dryer drum to condense in a tray below or vented to the outside of the machine. In this case, a hook or claw attachment on the device may also be included for supplemental attachment.

The reservoir for storing fabric treatment composition may be attachable to said support member in any suitable manner. Preferably the reservoir is attachable so as to lock into position.

The device may include transfer means to expose fabric treatment composition from the reservoir to airflow generated inside the tumble drier and/or to directly contact fabrics in the dryer, thereby transferring a portion of the fabric treatment composition into contact with fabrics in the tumble dryer during a tumble drying cycle.

The transfer means may be a dedicated component of the body or may form part of the device body and/or reservoir which may be a optionally integral.

The reservoir is preferably attachable to the support member to ensure fluid connection between the reservoir and the transfer means e.g. by a connecting channel or duct.

The fluid connection preferably includes an inlet port or channel for receiving a predetermined amount of the composition from the reservoir sufficient for a predetermined number of cycles at a given temperature, time and load size and may further include a charging port or channel or recess situated directly behind the transfer means.

The transfer of fabric treatment composition to the fabrics in the tumble drier may be effected solely by airflow generated in the tumble drier. Depending upon the model of the tumble drier and program setting temperatures of up to 100° C. with wet clothes may be generated within the tumble drier, generally in the range 30° C. to 80° C. for most drying cycles (the hot air generated by the heater in the tumble drier may be as high as 150° C., generally 110° C. to 120° C.).

In addition, the transfer may be constructed and arranged such that there may be direct contact between fabric in the tumble drier and the exposed fabric treatment composition in order to facilitate transfer of fabric treatment composition to the fabric.

The device may be configured to present a smooth external profile when attached to a door or wall. This feature has the advantage that it prevents or at least can reduce the possibility of the device damaging the fabrics as they move through the dryer. It may not be important that the attachment part of the device is smooth, if this is not exposed when the device is fixed in place. In one embodiment the external profile is generally hemispherical, and optionally including an upright (in use) portion as described above.

Preferably the device can be used to treat fabrics during multiple tumble drying cycles. With this arrangement, the dispenser may be more convenient as the user only need replenish the fabric treatment composition after a number of cycles.

The fabric treatment composition may be in the form of a liquid, solid or gel. The composition preferably comprises at least a perfume component and optionally water and may also comprise one or more perfume solubilisers. In this way the composition can act as a freshening composition.

In addition, according to a further aspect of the invention there is provided a kit for the treatment of fabrics in a tumble drying cycle, comprising the combination of the device of the first aspect of the together with a instructions for use of the device, including instructions for installation and/or refilling of said reservoir and optionally one or more further reservoirs and/or fabric treatment compositions.

In addition, according to the invention there is provided a method of treating fabrics in a tumble dryer during multiple tumble drying cycles comprising the steps of:

(a) attaching a support member according to the invention to the inside of a tumble dryer door, by the attachment means
(b) attaching a reservoir to the support member; and
(c) carrying out a tumble drying process with fabrics inside the tumble dryer.

Further provided in accordance with the invention is a tumble dryer with a support member (and optionally reservoir) of the device according to the invention attached therein.

Various non-limiting embodiments of the invention will now be more particularly described with reference to the following figures in which.

Figure 1:
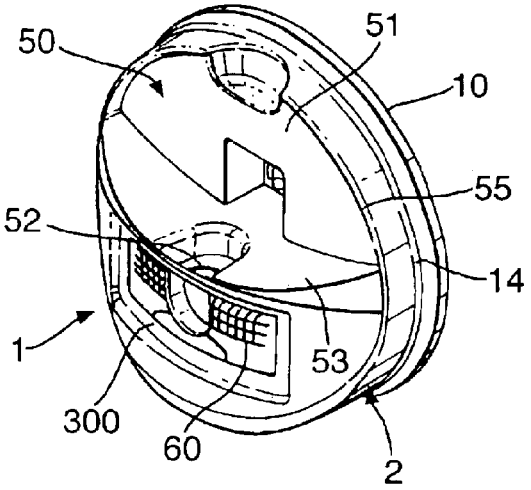
FIG. 1 is a perspective view of a device according to one aspect of the invention (reservoir not shown)

FIGS. 6*a*–6*g* are views of the reservoir for the device of FIG. 1.

Similar reference numbers are used throughout the figures to identify common features.

Referring to the drawings, there is illustrated a device 1 (shown orientated upright and viewed in perspective) for treating fabrics in a tumble dryer (not shown) during multiple tumble drying cycles, the device comprising a support member 2 and a reservoir 6 (shown in FIGS. 6*a*–6*g*) for storing fabric treatment composition. Reservoir 6 is attachable to said support member 2, the support member 2 including attachment means comprising a strip of repositionable fastener material e.g. hook and loop or mushroom head type e.g. Velcro™ (not shown). A strip of corresponding repositionable fastener material is also attached to the interior of the dryer for attachment of the support member 2 to the tumble dryer interior, and preferably the door, wherein the support member, includes a flexible skirt 10 which contacts the dryer interior and allow positional adjustment of the device relative to the tumble dryer interior, during attachment by the user.

With this arrangement, the user can positionally adjust the device during attachment to the dryer interior, and consequently achieve more effective attachment. The user can also apply force to the device to ensure attachment and the flexible skirt does not inhibit this. This is particularly advantage in this embodiment where the device is rigid and this rigidity could, without the presence of the skirt, restrict positional adjustment/application of sufficient force.

The flexible skirt 10 extends around the entire periphery of the device and ensures that when attached, there are no gaps around the periphery. Exclusion of gaps has at least two advantages. The first is that it is less likely that any articles of clothing or parts of articles can become trapped behind the device and pull the device off the door. Secondly, it is less likely that lint can become entrapped behind the device and build up over time.

The support member 2 is a generally hemispherical rigid element with a circular periphery 14 approximately 100 mm in diameter. The skirt 10 has an outer diameter (that is, the diameter which contacts the tumble dryer interior)of 117 mm And is approximately 8 mm deep.

Figure 3:
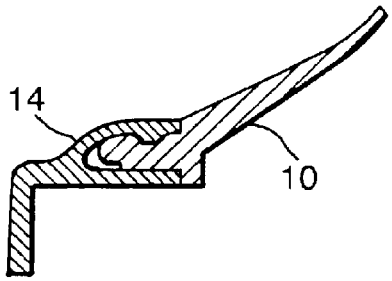
FIG. 3 is an enlarged sectional side view of the flexible portion and perimeter of the device of FIG. 1.
Figure 4:
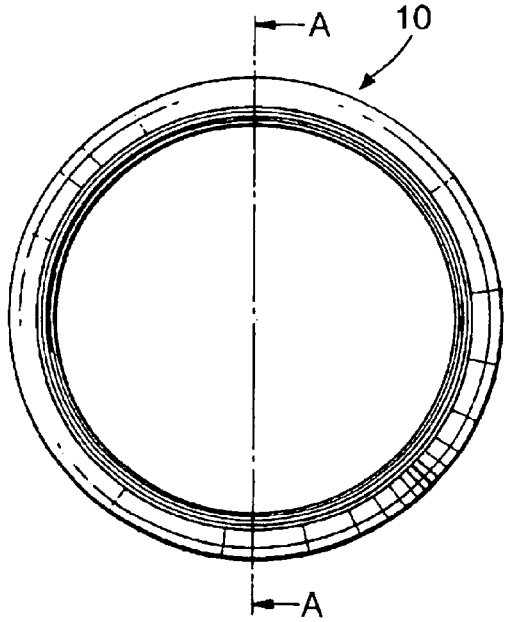
FIG. 4 is a plan view of the flexible portion (no other parts shown)

The skirt 10 and periphery are attached by interlocking as shown in FIG. 3.

The flexible skirt 10 is formed from a TPE (thermoplastic elastomer).

The attachment means is positioned centrally of the support member 2 and skirt 10, remote from the latter. In this when force is applied to the device in the area of the attachment means it is not necessarily directly applied to the flexible portion/s, allowing optimal positional adjustment and attachment.

Figure 2:
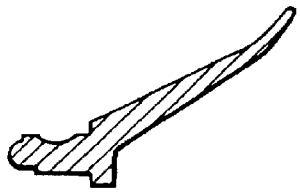
FIG. 2 is an enlarged sectional side view of the flexible portion of the device of FIG. 1.
Figure 5:
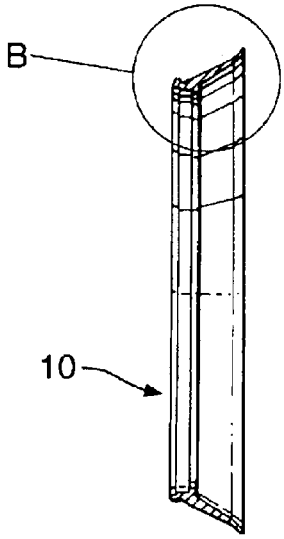
FIG. 5 is a section A—A on FIG. 4.
Figure 6A:
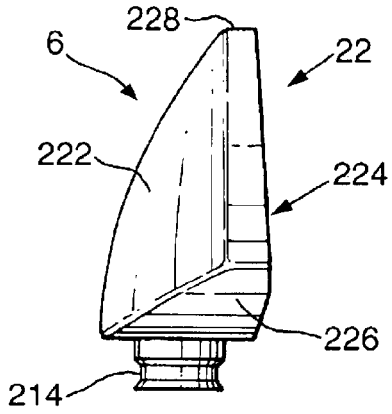
Figure 6B:
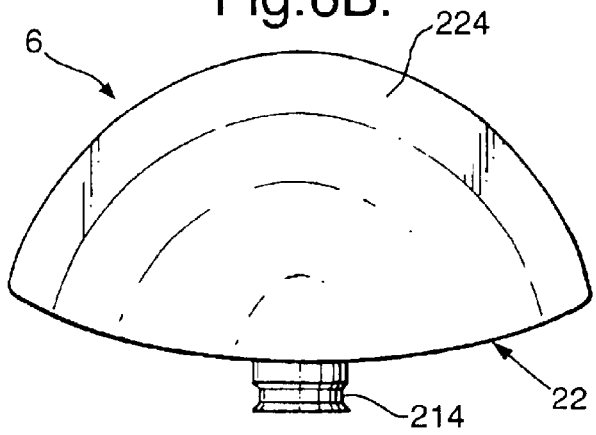
Figure 6C:
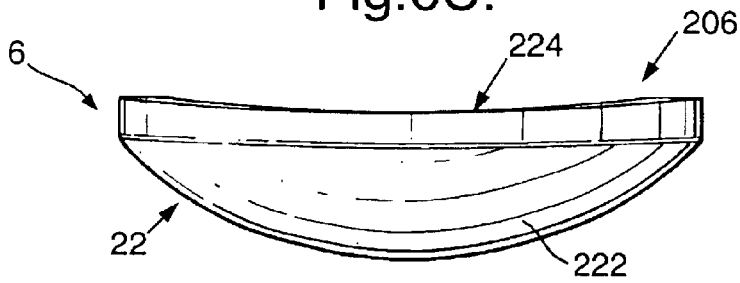
Figure 6D:
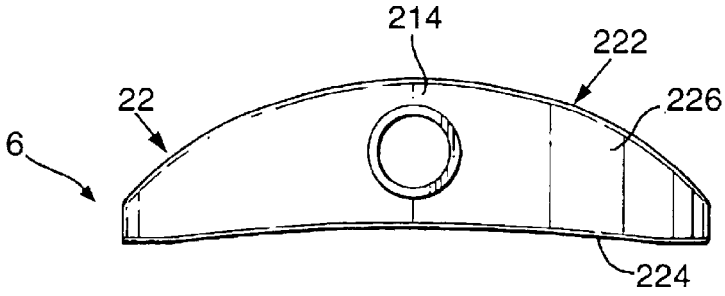
Figure 6E:
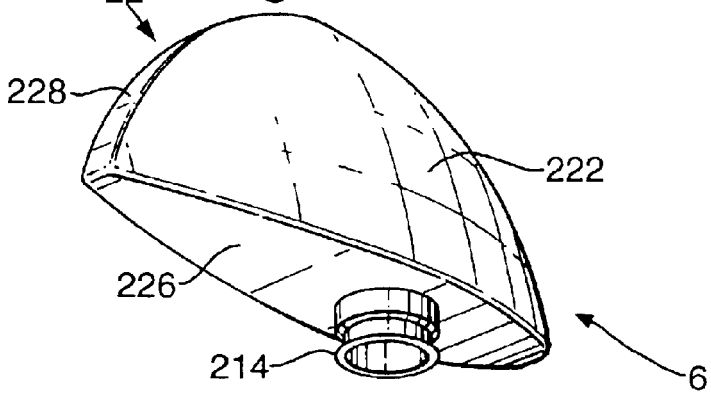
Figure 6F:
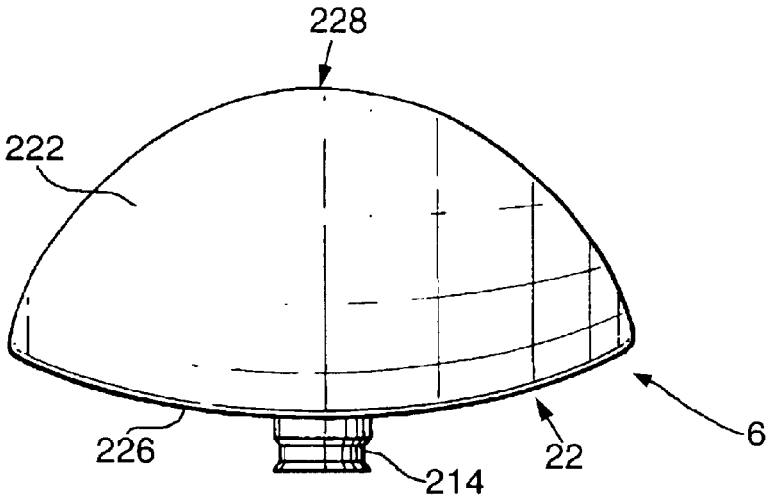
Figure 6G:
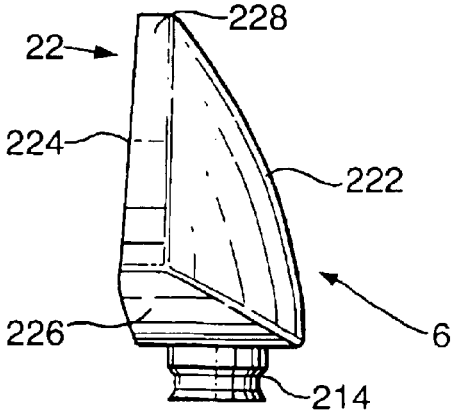

As shown more clearly in FIGS. 2,3 and 5, the flexible skirt 10 is inclined outwardly, relative to the direction of main component of the force for attachment to allow greater flexing of the perimeter during attachment.

The flexible skirt 10 has a curved profile, wherein the curvature follows in the direction of the above mentioned inclination.

Some modern tumble dryers have a one or more small holes in the inside of the door to allow moisture out of the tumble dryer drum to condense in a tray below or vented to the outside of the machine. In this case, a hook or claw attachment on the device is included for supplemental attachment (not shown).

The reservoir 6 comprises a rigid dome shaped body 20 housing a reservoir bottle 22 configured for snap-fit engagement in recess 50 of support member 2. The reservoir recess 50 constitutes a major part of the upper half of the member 2 ('upper' when orientated upright).

The reservoir 6 is attachable to the support member 2 so as to lock into position.

As shown more clearly in FIG. 1, the reservoir body 20 includes a chamber or inlet port 52, having a capacity to hold a predetermined volume of fluid freshener, which is, in this embodiment 1.5 ml and is sufficient for one drying cycle of 1 hour at 60 degrees C. However, the inlet port may have a volume sufficient for any number of cycles. The port 52 is located beneath (when the device is held oriented as shown in FIG. 1—as it would be in use) and in fluid communication with the reservoir recess 50 to allow liquid to enter the port 52 from the reservoir bottle 22 when it is in place in the recess 50.

The rear of the device (not shown) is recessed and also contains a hook 300 for supplemental attachment to the tumble dryer door of e.g. condenser dryers (which have slots or holes in the door or pitted surface). One possible hook shape is shown comprising an elongate arm which is pivotable about a pivot through about 90 degrees, between a storage position in which the hook is enclosed within the rear recess and an attachment position in which it projects from the device. The hook is curved only where it connects with the device—it is straight at the opposite end, as the gentle curve blocks the removal of the machine filter in some machines, so needs to be removed from the design for such machines.

As shown in FIGS. 6*a*–6*g*, the reservoir bottle 22 comprises a polypropylene bottle with body portion and neck portion 214. The body portion is defined by three main generally crescent shaped faces: a front face 222 and a rear face 224 and a shoulder face 226. The front and rear faces 222,224, extend from opposed edges of the shoulder face 226 and depend therefrom to meet at a common curved edge 228. The radius of curvature of the rear face 224 is less than that of the front face 222.

The reservoir recess 50, has a curved back wall 51, base wall 53 and top wall or lip 55 which correspond in shape with the rear face 222 shoulder face 226 and edge 228 respectively so that the reservoir is retained in the recess by the walls 53,55,and by the engagement of the neck portion 214 with the port 52. The neck is configured for engagement with the inlet port 52, taking into account of any seals: The inlet port 52 may include an annular resilient seal of a thermoplastic elastomer (TPE) to ensure leak proof engagement of the reservoir bottle 22 with the port 52.

The reservoir bottle 22 preferably has a pin-hole (not shown) in an upper region e.g. the edge region or front face or back surface so that as fluid freshener leaves the bottle it can be replaced with air, gradually, so as not to interfere with the gradual flow of the fluid to the membrane. This has the advantage of ensuring consistency in delivery of composition.

Insertion and removal is aided by limited flexibility of the refill bottle 22 and support member 2 such that snap-fit installation and removal can be effected easily.

The device shown further includes a transfer means and is general dome shape is modified by inclining the portion housing the transfer means outwardly, so that in use (i.e. attached to an upright tumble dryer door or wall) the transfer means is orientated upright.

The transfer means comprises two flow control members (not shown in detail but indicated at 300): an inner delicate but precise flow control member and an outer compressed foam layer. The inner flow control member is a polypropylene membrane with a thickness of 160 microns and a pore size of 0.2 microns. However other thickness/pore size values may be used, the appropriate pore size and thickness of the membrane varying depending on the fabric treatment composition viscosity, and the delivery rate required.

The compressed foam has a compression ratio (or 'firmness') of 8, having been compressed from an initial thickness of 42 mm to a compressed thickness of 6mm. The foam has an (initial, i.e. pre-compression) pore size (PPI, pores per liner inch) of 80 ppi. The foam is compressed by heat and pressure to produce a permanent compression—no compression devices are needed.

The foam is a polyester foam the density of the foam material is 0.383 $g/cm^3$=$kg/m^3$ (=23.9 pounds per cubic foot.).

The foam and membrane are fixed around their perimeters preferably by ultrasonic welds and preferably, to enable a better seal (for the purpose of preventing leaking of the fabric treatment composition), by a substantially continuous weld, to a window frame (not shown but window area indicated at 300 in FIG. 1).

Optionally, the inlet port 52, is integral with the window frame, again, to enable a leak proof system. The manufacture of the framed membrane involves melting upstanding ribs on the frame by ultrasonic welding so as to weld these to the perimeter of the membrane. The framed membrane is attached to the support member 2(by the ultrasonic welding which is done with the port/frame/membrane in situ in the device body).

The area inside of the welded perimeter provides the effective flow control area that is to say the active part of the flow control members.

In the embodiments shown, the area is 40×27 mm=1080 $mm^2$. other embodiments (not shown) may have a larger area of 50×27 mm=1350 $mm^2$, or larger still, such as 80×30=2400 $mm^2$. Preferably the effective part of the transfer means has an area in the range 500–5000 $mm^2$ including all ranges subsumed therein.

Behind the members is a recess of corresponding shape which has a slightly projecting perimeter region for attachment of the frame thereto, so that a gap is defined between the inner member and the recess wall. In this narrow gap approximately 2–3 mm, a small amount of freshener fluid can collect to 'charge' or 'feed' the members continuously without causing leakages.

Ribs 60 in the recess behind the transfer member function to deliver fabric treatment composition to all parts of transfer means, preventing blocking of any parts of the transfer means. The ribs 60 also function to adi priming or charging of the device quickly (ie. When using the device initially).

It is important to prevent leakage of the fabric treatment composition, as this can lead to staining of fabrics.

In use the reservoir is disposed with the neck pointing downwards, engaging the inlet port so that fluid from the reservoir flows, under gravity to the port and then to the members from where it evaporates/transfers in the dryer.

The fabric treatment composition may take any suitable form, for example it may be as described in any of the following embodiments (e.g. solid, liquid, gel at room temperature).

What is claimed is:

1. A device for treating fabrics in a tumble dryer during multiple tumble drying cycles, the device comprising a support member attachable to a reservoir for storing fabric treatment composition, the support member including attachment means for attachment of the device to the tumble dryer interior, wherein the device includes one or more flexible portions which contact the dryer interior and allow positional adjustment of the device relative to the tumble dryer interior, during attachment by a user.

2. A device according to claim 1 wherein the flexible portion extends around the entire perpiphery of the device and ensures that when attached, there are no gaps around the periphery.

3. A device according to any claim 1 wherein the device has a rigid perimeter which is bounded by a flexible edging or skirt.

4. A device according to claim 1 wherein the device has a curved e.g. circular or oval perimeter.

5. A device according to claim 1 wherein the device has diameter of from about 60 to about 140 mm.

6. A device according to claim 1 wherein the device has diameter of from about 70 to about 140 mm.

7. A device according to claim 1 wherein the device has diameter of approximately 100 mm.

8. A device according to claim 1 wherein the flexible portion has an outer diameter, for contacting the tumble dryer interior, of from about 70 to about 120 mm.

9. A device according to claim 1 wherein the flexible portion e.g. skirt is at least 8 mm deep.

10. A device according to claim 1 wherein the attachment means includes a suction cup arrangement.

11. A device according to claim 1 wherein the attachment means includes a hook-and-loop or mushroom-head type reclosable fastener.

12. A device according to claim 1 wherein the attachment means is remote from the flexible portion/s.

13. A device according to claim 1 wherein the attachment means is at least in part surrounded by the or each flexible portion/s.

14. A device according to claim 1 wherein the flexible portion/s is/are inclined outwardly relative to the direction of main component of the force for attachment to allow greater flexing of the perimeter during attachment.

15. A device according to claim 1 wherein the flexible portion/s may have, in whole or part, a curved profile.

16. A device according to claim 1 wherein the flexible portion/s is/are curved in the direction of the inclination.

17. A device according to claim 1 wherein the attachment means for attachment of the device to the tumble dryer interior attaches the device to the door.

18. A device according to claim 1 wherein the support member includes one or more flexible potions which contact the dryer interior and allow positional adjustment of the device relative to the tumble dryer interior.

19. A tumble dryer with a device according to claim 1 attached therein.

* * * * *